United States Patent [19]

Struck et al.

[11] 4,299,356

[45] Nov. 10, 1981

[54] SPRAY NOZZLE FOR COKE OVEN GAS-COLLECTING SYSTEM

[75] Inventors: Carl-Heinz Struck, Bochum; Ralf Schumacher, Hagen, both of Fed. Rep. of Germany

[73] Assignee: Dr. C. Otto & Comp. G.m.b.H., Bochum, Fed. Rep. of Germany

[21] Appl. No.: 147,706

[22] Filed: May 8, 1980

[30] Foreign Application Priority Data

May 19, 1979 [DE] Fed. Rep. of Germany ..... 2920326

[51] Int. Cl.[3] ..... B05B 1/02; B05B 1/14; C10B 27/06

[52] U.S. Cl. ..... 239/558; 202/260; 202/256; 261/118

[58] Field of Search ..... 239/558, 559, 589; 202/254–261, 263; 261/116, 118

[56] References Cited

U.S. PATENT DOCUMENTS

| | | | |
|---|---|---|---|
| 1,151,259 | 8/1915 | Fischer | 261/116 |
| 1,846,493 | 2/1932 | Kahr | 239/558 |
| 1,982,538 | 11/1934 | Reedy | 239/559 X |
| 2,082,118 | 6/1937 | Potter | 202/258 |
| 2,603,232 | 7/1952 | Keammerer | 202/258 X |
| 3,092,333 | 6/1963 | Gaiotto | 239/558 X |
| 3,309,286 | 3/1967 | Alderman | 202/258 |
| 4,168,208 | 9/1979 | Althoff et al. | 202/254 |

*Primary Examiner*—Frank W. Lutter
*Assistant Examiner*—Roger F. Phillips
*Attorney, Agent, or Firm*—Thomas H. Murray

[57] ABSTRACT

A spray nozzle for use in the elbow interconnecting a coke oven ascension pipe and a main, characterized in having frusto-conical nozzle orifices which generate sprays which completely cover the elbow cross section only when they reach the transition between the elbow and the coke oven main.

11 Claims, 7 Drawing Figures

SPRAY NOZZLE FOR COKE OVEN GAS-COLLECTING SYSTEM

BACKGROUND OF THE INVENTION

As is known, a coke oven gas-collecting system includes an ascension pipe, leading from a coking chamber, which is connected through an elbow to the gas main for the coke oven installation. A nozzle projects through the wall of the elbow and is used not only during operation of the ovens for the introduction of an ammonia-containing liquid at a pressure of several bars, but is also used to extract, with the use of very high pressure liquid, the gases evolved during charging which pass upwardly through the top gas-collecting chamber and the ascension pipe into the main. It is, of course, desirable to provide a nozzle which will produce a spray having the maximum possible effect in extracting undesirable components from the evolved gases.

SUMMARY OF THE INVENTION

In accordance with the present invention, a new and improved nozzle construction is provided for coke oven elbow sections which is simple in construction but which, at the same time, facilitates the extraction of very considerable quantities of gas with the use of predetermined high pressures and predetermined liquid flow rates. In the light of detailed experiments, the optimum construction for such a multi-orificed nozzle is achieved if the nozzle orifices widen in generally frusto-conical shapes from the entrance to the exit ends thereof such that the streams produced by the nozzles completely fill the elbow cross section only when they reach the transition between the elbow and the coke even main.

In contrast to cylindrical orifices in which the issuing streams of liquid remain in tact, the frusto-conical orifices according to the invention produce streams of liquid which break up after leaving the nozzle such that the liquid entrains a very large quantity of gas.

The above and other objects and features of the invention will become apparent from the following detailed description taken in connection with the accompanying drawings which form a part of this specification, and in which.

Figure 1:
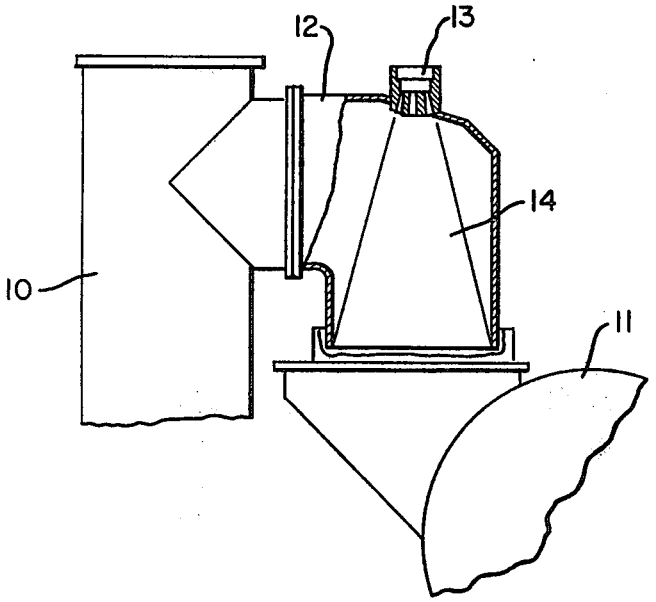
FIG. 1 is a broken-away elevational view showing the multi-orificed nozzle of the invention positioned within an elbow which interconnects the ascension pipe and main of a regenerative coke oven.

Referring now to the drawings, and particularly to FIG. 1, there is shown a conventional ascension pipe 10 for a regenerative coke oven installation connected to a coke oven main 11 through an elbow 12. The multi-orificed nozzle of the invention is identified by the reference numeral 13 and projects through the top wall of the elbow 10. Water or other liquid in the form of droplets issues from the nozzle 13 in a cone-shaped configuration 14 which fills the entire cross section of the elbow only at the junction or transition between the elbow and the main 11.

Figure 2A:
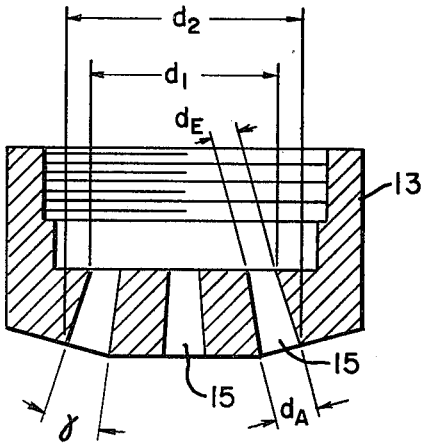
FIGS. 2A and 2B are vertical cross-sectional views through the axes of two different nozzles, the base thicknesses of the respective nozzles being different such that the lengths of the nozzle orifices vary.
Figure 2B:
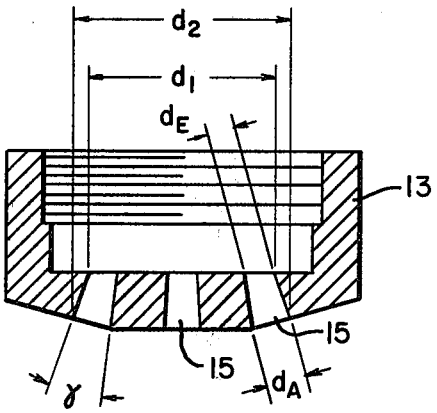
Figure 3A:
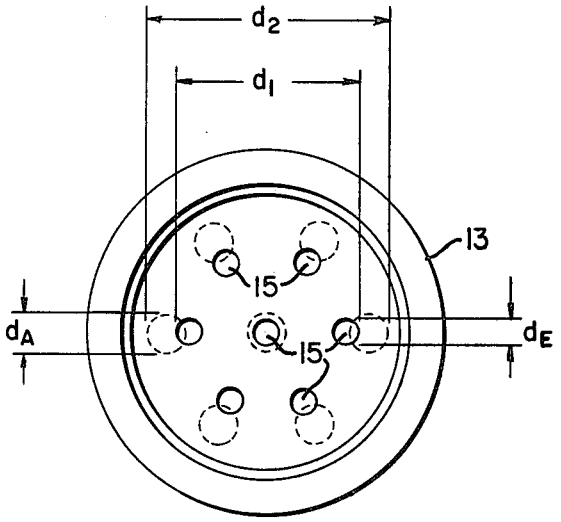
FIG. 3A is a diagrammatic top view of a nozzle constructed in accordance with the invention showing the relative sizes of the nozzle orifice ends on the liquid entrance and exit ends.
Figure 3B:
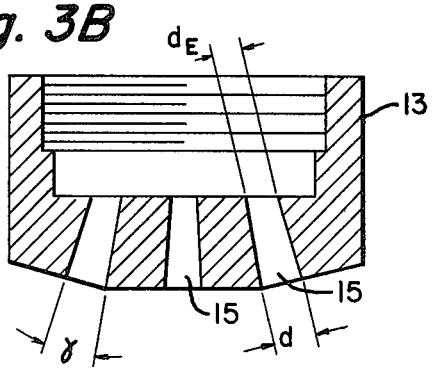
FIG. 3B is a vertical cross-sectional view of a nozzle constructed in accordance with the invention in which there are seven orifices.

As shown in FIGS. 2A and 2B, the nozzle 13 is generally cup-shaped and has a cylindrical side wall and a bottom wall through which generally frusto-conical nozzles 15 extend. The orifices have a diameter $d_E$ on the water entry side and a larger diameter $d_A$ on the water exit side. With specific reference to FIGS. 2A, 2B, 3A and 3B, the orifices on the water entry side are disposed on a circle of diameter $d_1$. That is, they are tangential to a circle which is external to the circles formed by the entry orifices of diameter $d_E$. An external circle which is tangential to the exit openings (of diameter $d_A$) has a diameter $d_2$. The frustoconical orifices widen, as shown in the drawings, by a cone opening angle $\gamma$.

Actual experiments have shown that the following values are optimal for a given liquid input pressure to the nozzle to provide maximum gas removal as the gas travels from the ascension pipe 10 to the main 11. First, the square of the ratio of the entrance orifice diameter $d_E$ to the exit orifice diameter $d_A$, $(d_E/d_A)^2$, should be between 0.4 and 0.85 and preferably between 0.65 and 0.70. This ratio, of course, is a measurement of the widening of the orifice, and can vary depending upon the length of the orifice. The optimum value for the cone opening angle $\gamma$ is between 2° and 10° and preferably between 3° and 7°. If the orifices are arranged in a circle, the ratio of the diameter $d_1$ on the entry side to the diameter $d_2$ on the exit side, $(d_1/d_2)$, is between 0.5 and 0.95 and preferably between 0.8 and 0.9.

Figure 4A:
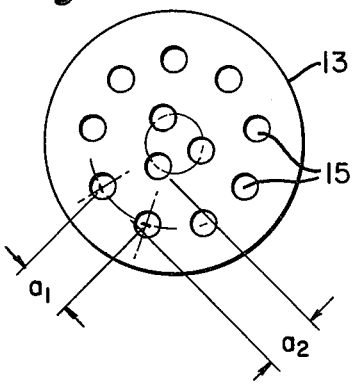
FIGS. 4A and 4B are bottom views of two different types of nozzles constructed in accordance with the invention showing the manner in which the nozzle orifices can be arranged in concentric circles in different nozzle designs.
Figure 4B:
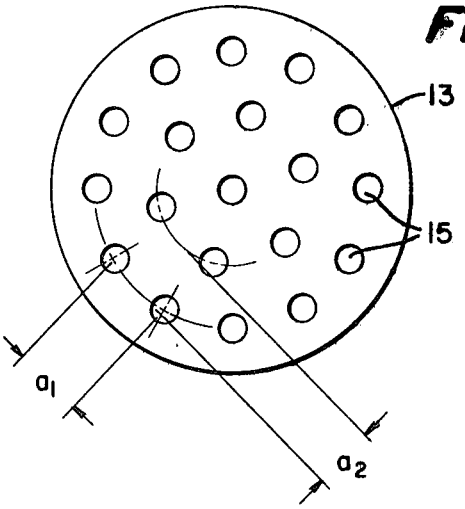

The vertical position of the nozzle 13 can be readily adjusted within the elbow 12 to adapt it to different pressure conditions or other operating parameters. In addition to a central orifice or a group of three or four orifices near the center of the nozzle, the orifices can be arranged in one or more outer circles as shown in FIGS. 4A and 4B. The number of orifices used in each circle depends upon the quantity of liquid which is required to be sprayed, the pressure that is required, and other operating parameters.

To optimize the characteristics of a particular nozzle employed, the distance between individual orifices in any circle of orifices should have an optimal value in relation to orifice diameter. It has been found that the ratio of the distance $a_1$ (FIGS. 4A and 4B) between the centers of adjacent orifices in the same circle to the diameter $d_A$, $(a_1/d_A)$, is 1.8 to 2.8 and preferably 2.4. When there is a number of orifice circles as in the case of the nozzles shown in FIGS. 4A and 4B, the ratio of the radial interval $a_2$ to the orifice diameter $d_A$, $(a_2/d_A)$, on the liquid exit side should be between 1.5 and 2.6 and preferably 2.1.

If the foregoing parameters and arrangement of the orifices are observed, maximum gas extraction values per unit of time can be obtained for a liquid input to the nozzle at a particular pressure and flow rate.

Although the invention has been shown in connection with certain specific embodiments, it will be readily apparent to those skilled in the art that various changes in form and arrangement of parts may be made to suit requirements without departing from the spirit and scope of the invention.

What we claim as our invention:

1. A liquid-spraying multi-orificed nozzle adapted to be fitted into the elbow interconnecting the ascension pipe and main of a coke oven, comprising a generally cup-shaped element having a cylindrical side wall and a bottom wall, and nozzle orifices in said bottom wall, said orifices being frusto-conical in configuration throughout their entire lengths from one side of the bottom wall to the other and being wider at their exit ends than at their entrance ends, the group of nozzle orifices being characterized in producing streams of liquid which completely cover the elbow cross section only when they reach the transition of the elbow to the coke oven main.

2. The nozzle of claim 1 wherein the square of the ratio of the orifice diameter $d_E$ on the water entry side to the orifice diameter $d_A$ on the water exit side is between 0.4 and 0.85.

3. The nozzle of claim 2 wherein the square of said ratio is between 0.65 and 0.70.

4. The nozzle of claim 1 wherein said orifices are arranged in a circle in said bottom wall with the ratio of the diameter $d_1$ of an external peripheral circle of the orifices on the entry side to the diameter $d_2$ of an external peripheral circle on the exit side is between 0.5 and 0.95.

5. The nozzle of claim 4 wherein the ratio of the diameter $d_1$ to the diameter $d_2$ is between 0.8 and 0.9.

6. The nozzle of claim 1 wherein the cone opening angle $\gamma$ which determines the frustum-like widening of the orifices is between 2° and 10°.

7. The nozzle of claim 6 wherein said angle $\gamma$ is between 3° and 7°.

8. The nozzle of claim 1 wherein said nozzle orifices are arranged in a circle and the ratio of the distance $a_1$ between adjacent orifices in the circle to the exit diameters $d_A$ of the orifices is between 1.8 and 2.8.

9. The nozzle of claim 8 wherein said ratio of $a_1$ to $d_A$ is 2.4.

10. The nozzle of claim 1 wherein said nozzle orifices are arranged in concentric circles and the ratio of the radial distance $a_2$ between the centers of orifices in adjacent circles to the exit diameters $d_A$ of the orifices is between 1.5 and 2.6.

11. The nozzle of claim 10 wherein said ratio of $a_2$ to $d_A$ is 2.1.

* * * * *